United States Patent [19]

Schweitzer

[11] 4,064,804

[45] Dec. 27, 1977

[54] DUPLICATOR AND METHOD OF DUPLICATING

[75] Inventor: Roy C. Schweitzer, Hoffman Estates, Ill.

[73] Assignee: Addressograph Multigraph Corporation, Cleveland, Ohio

[21] Appl. No.: 590,700

[22] Filed: June 26, 1975

[51] Int. Cl.[2] ..... B41M 1/06; B41F 7/24; B41F 31/00

[52] U.S. Cl. ..... 101/451; 101/132.5; 101/147; 101/350; 118/7; 222/54

[58] Field of Search ..... 101/132, 132.5, 136, 101/137, 141, 142, 450, 335, 350, 351, 360, 361, 363, 364, 147, 148, 144, 451; 118/5, 7, 8; 222/54, 70; 137/79

[56] References Cited

U.S. PATENT DOCUMENTS

| | | | |
|---|---|---|---|
| 3,147,704 | 9/1964 | Nothmann | 101/350 |
| 3,301,182 | 1/1967 | Leviton | 101/351 |
| 3,354,823 | 11/1967 | Lake | 101/363 X |
| 3,451,336 | 6/1969 | Mignone | 101/132.5 |
| 3,457,857 | 7/1969 | Burger | 101/144 |
| 3,567,923 | 3/1971 | Hutchinson | 101/350 X |
| 3,683,803 | 8/1972 | Gray et al. | 101/132 |
| 3,741,115 | 6/1973 | Keller | 101/350 X |
| 3,749,009 | 7/1973 | Suzuki | 101/366 X |
| 3,776,133 | 12/1973 | Ritzerfeld | 101/147 |
| 3,888,173 | 6/1975 | Ritzerfeld | 101/350 |

*Primary Examiner*—Edgar S. Burr
*Assistant Examiner*—R. E. Suter
*Attorney, Agent, or Firm*—Russell L. Root

[57] ABSTRACT

A duplicator system and method are provided for preparing a lithographic master and for producing duplicated copies from the master in a fully automated system. An ink and moisture system is provided for supplying ink and moisture to a master on a master cylinder. During a pre-inking phase, an ink ductor roller is operative for a predetermined duration within variable ranges, as determined by the number of duplicated copies to be reproduced, and a moisture roller is operative to transmit moisture to the inking system. An early moisture circuit is also provided for conditioning the system by supplying moisture prior to a pre-inking phase in those instances wherein there has been a significant delay between the processing of two consecutive masters. Control means including a sensing device is provided for sensing the ambient temperature at an ink fountain and providing an indication thereof at predetermined temperature values. Subsequent to the pre-inking phase and during a normal duplicating operation, in response to an indication of the sensed temperature, the speed of transfer of ink from the ink fountain to the ink form roller is automatically controlled by altering the movement of the ink ductor roller, i.e. by interrupting the ducting action of the ductor roller for preselected time intervals. Thus, as the viscosity of the ink changes in response to the temperature, the control means is effective to vary the ducting pattern of the ink ductor roller such that an amount of ink substantially suited to the temperature situation is applied to the master.

18 Claims, 10 Drawing Figures

101
102
106
110
112
114
115
116
116a
118
119
120
122
124
126
128
130
131
132
134
136
138
140

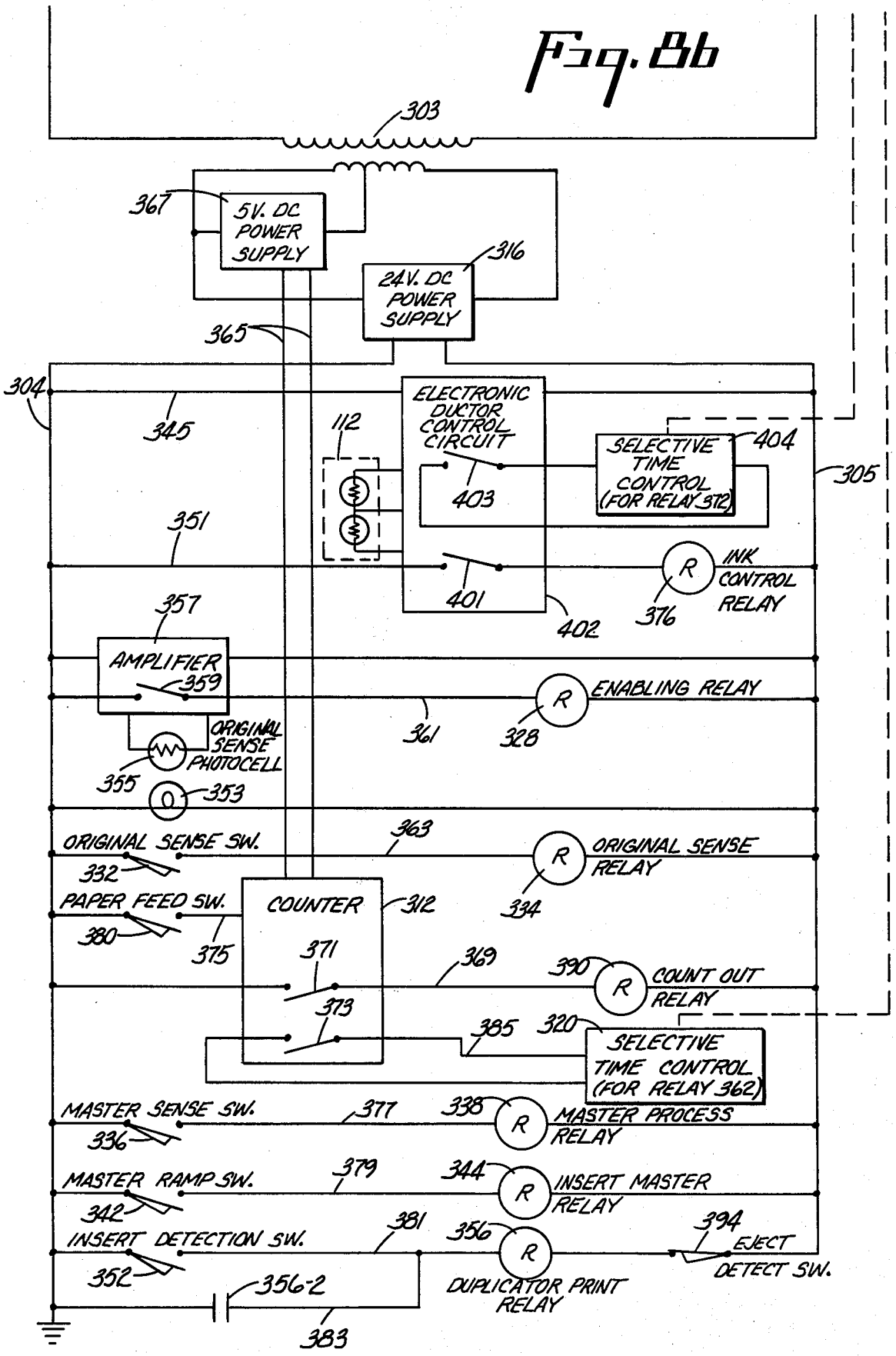
Fig. 8b
303
367
5V. DC POWER SUPPLY
316
24V. DC POWER SUPPLY
365
304
345
112
ELECTRONIC DUCTOR CONTROL CIRCUIT
403
SELECTIVE TIME CONTROL (FOR RELAY 312)
404
305
351
R
INK CONTROL RELAY
376
401
402
357
AMPLIFIER
359
R
ENABLING RELAY
361
328
ORIGINAL SENSE PHOTOCELL
355
353
ORIGINAL SENSE SW.
363
R
ORIGINAL SENSE RELAY
332
334
PAPER FEED SW.
COUNTER
312
380
375
371
369
390
R
COUNT OUT RELAY
373
385
320
SELECTIVE TIME CONTROL (FOR RELAY 362)
MASTER SENSE SW.
377
338
R
MASTER PROCESS RELAY
336
MASTER RAMP SW.
379
344
R
INSERT MASTER RELAY
342
INSERT DETECTION SW.
381
356
R
394
EJECT DETECT SW.
352
356-2
DUPLICATOR PRINT RELAY
383

DUPLICATOR AND METHOD OF DUPLICATING

BACKGROUND OF THE INVENTION

Duplicating machines for the production of duplicated copies of an original by the lithographic technique to rapidly produce reproductions are known in the art. However, while some of these devices provide substantially automated operation, in many respects they do not provide built-in controls for maintaining a proper ink and moisture balance and supply in response to various conditions which tend to upset this balance and require close and skillful monitoring by an operator.

In most duplicator systems heretofore available, moisture is transferred to the form roll as soon as the duplicator printing couple is actuated. Hence, an attendant operator is required to perform manual adjustments for increasing or decreasing the fountain solution flow depending upon whether or not copies are being run. If such a duplicating system were not attended by an operator, the moisture transfer from the solution reservoir throughout the ink and moisture roller complex occurs for some period of time before the master is inserted on the master cylinder. Then, when the form roller is brought into contact, it transfers a surplus of moisture to the master which cannot be used or carried off on the copy sheets fast enough to combat a washed-out copy look.

In view of the varying temperatures under which duplicating machines are operated and subjected to, the viscosity of the ink in the ink reservoir of the machine can vary from a rather thick consistency at low ambient temperatures to a relatively thin consistency at high temperatures. Ink having a thick consistency does not flow readily into the copy paper surface and therefore requires an increase in the volume of ink transferred from the fountain roller to the form roller. On the other hand, as the viscosity of the ink decreases and the ink thins out and both flows more readily onto the copy sheets and is more readily absorbed by them, it requires a reduction in the volume of ink transferred to the form roller. The foregoing situation is normally taken care of by means of the general purpose manual ink adjustments on the duplicating machine, which adjustments require considerable skill on the part of an operator, and usually prevent the use of the duplicator by secretaries or other casual operators.

SUMMARY OF THE INVENTION

In the discussion of the invention hereinbelow the term automatically is used in its broad sense to characterize the performance of actions which are caused to occur spontaneously in response to machine conditions or operation, or in response to signals such as electrical signals, and which therefore do not require operator action to bring them about, and is used in this sense in the present specification and the subjoined claims.

The invention relates generally to the production of multiple copies from a series of lithographic masters and, in the specific form shown, relates to a method and means for duplicating copies of an original by integrating photoimaging techniques with the lithographic technique to automatically and rapidly produce high quality reproductions.

It is an object of the present invention to provide a fully automatic, casual operator lithographic duplicator apparatus and process for producing preselected quantities of duplicated copies of high quality and at a high speed.

Another object of the invention is to provide an ink and moisture system which maintains the quality of the duplicated copies over the course of time, including the ability of operation in a changing environment, without operator adjustment.

Another object of the invention is to provide, in combination with a duplicator ink and moisture system of the above type, a disposable ink reservoir which eliminates the need for ink fountain clean up. Also, because the ink is packaged in a disposable container so that the ink is not exposed to the atmosphere, there is minimum skinning or contamination of the ink.

A further object of the invention is to provide control means associated with a preset counter for controlling the duration of the supply of ink and moisture to the master on the cylinder during a pre-inking phase, prior to duplicating the first copy sheet.

Another object of the invention is to provide control means including sensing means for sensing the temperature at the ink fountain and controlling the volume of ink conducted to the master during a normal duplicating operation in accordance with the temperature sensed.

A further object of the invention is to provide means operative to transmit moisture to the form roller or rollers prior to a pre-inking phase, and prior to attachment of the master onto the master cylinder, in those instances wherein there has been a predetermined time lapse between the processing of two consecutive masters.

Another object of the invention is to provide an apparatus for and method of duplicating which is simple, efficient and capable of turning out reproductions of consistently high quality requiring no special operator training or skill and a minimum of servicing or maintenance.

Other objects and advantages of the invention will appear hereinafter as the description proceeds.

The apparatus shown and described includes a master making portion which exposes a charged photoconductive sheet to a light and shadow image of the original to form a reverse reading latent electrostatic image thereon, develops the latent image thus formed on the sheet and treats the sheet to convert the surface coating in the background areas to hydrophilic condition so that the sheet may perform as a lithographic master. The apparatus as shown and described also includes an automated direct printing rotary lithographic duplicator which automatically takes each master thus prepared, places it on the master cylinder, prints by direct contact between the master and receiving sheets, making the desired number of copies in accordance with a preset counter setting, discharges the master and triggers the master making portion section to accept and process another waiting original.

The present invention is concerned mainly with the method and apparatus for providing automatic control of the ink and moisture system of the lithographic duplicator, which can be of several different basic types. The form specifically shown is a combined ink and moisture system for selectively applying ink and moisture to the image and non-image areas of the master respectively, by means of a common form roll.

One aspect of the automated means for controlling the transfer of ink and moisture volume involves adjusting the time during which the duplicator is in a pre-inking phase. The pre-inking phase is the period during which ink and moisture are first applied to the master on the master cylinder to place it in condition to start duplicating. The duration of the pre-inking phase is under control of a count compensating control in accordance with predetermined ranges of copy quantity set in the preset counter. Thus, the duration of the pre-inking phase is governed by the number of duplicated copies to be made from a master such that for very short runs a shorter duration of the pre-inking phase is employed and for normal or long runs, a more extended pre-inking phase is used.

Further, the present invention includes a temperature compensating control means including a sensing device, which control means operates to control the amount of ink conveyed by the ink system to the form roll in response to the temperature sensed. In the form shown this is done by altering the movement or the duct pattern of an ink ductor roller to thereby maintain a proper supply of ink to the master without attendant operator adjustment. As the ambient temperature increases the viscosity of the ink decreases and its flowability increases and as the temperature decreases the viscosity of the ink increases and its flowability decreases, and it is important that the volume of flow be adjusted to accommodate these differences.

Moisture transfer control is also provided to prevent moisture transfer to the form roller until such time as the master is inserted on the master cylinder, whereby the moisture transfer takes place during the pre-inking phase and simultaneously with the count compensating control explained hereinabove. In this way, by automatically preventing moisture transfer to the form roll during idling until the master is on the cylinder, ink dilution during idling is prevented.

The invention also provides a control for early actuation of the fountain solution means, prior to a pre-inking phase in all cases where there has been a delay of some predetermined extent (in the present instance five minutes or more) between the processing of two consecutive masters. Because such a delay may create an unbalanced ink and moisture condition on the roller complex, the early supply of fountain solution to the inking system is effective to condition the ink-moisture balance in advance of the pre-inking phase such that during the pre-inking phase, with the master attached on the cylinder, the master will be at once supplied with a properly metered amount of ink and moisture to produce high quality copies at the outset of the run.

IN THE DRAWINGS

FIGS. 8A and 8B are portions of a wiring diagram of the circuitry for controlling the sequence of operations.

GENERAL DESCRIPTION OF THE DUPLICATOR

Figure 1:
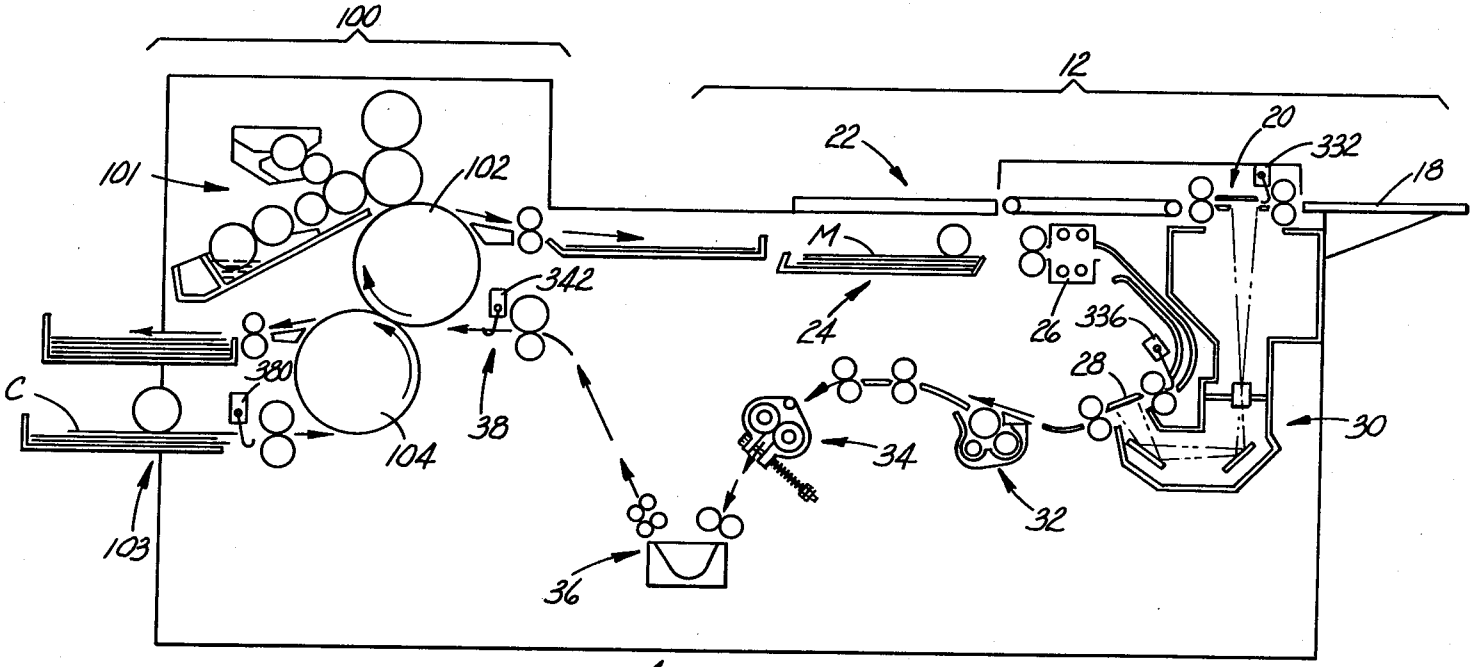
FIG. 1 is a diagrammatic elevation of a copier duplicator machine according to the present invention.

A machine according to the present invention is shown in FIG. 1, identified generally by the numeral 10. The machine includes a master maker section 12 and a lithographic duplicator section 100. The master maker 12 has a feed table 18 for supporting originals of which copies are to be made. The originals are passed one by one through an illumination station 20 and onto a receiving table 22.

Sumultaneously with the feeding of an original, an electrostatic master sheet M is fed from a hopper 24 past a charging station 26 and an exposure window 28 to progressively receive the projection of the image from the illumination station 20 via an optical system 30.

The latent image on the thus imaged master is developed with electroscopic powder at a developing station 32 which is shown as a magnetic brush developer, and from there it is moved to a fixing station 34 where the powder image is firmly secured to the master surface in any suitable manner. In the preferred form shown, the fixing station 34 consists of pressure rollers which exert high pressure on the sheet under ambient temperature conditions and thus complete the fixing of the image to the master sheet at high speed without the application of heat or radiant energy.

The master is then treated with a liquid composition at a conversion station 36, by which the background areas of the master sheet are converted to hydrophilic, ink-rejecting conditions, and the master is then fed to a waiting station 38 where it rests until the immediately previous duplicating cycle has been completed.

The duplicator 100 includes a master cylinder 102 and an impression cylinder 104 as well as an ink and moisture system 101, and a supply system 103 for copy sheets C. The duplicator receives imaged master sheets M from the waiting station 38 and employs them in the production of lithographic copies, by imprinting the individual copy sheets.

THE INK AND MOISTURE SYSTEM

Figure 3:
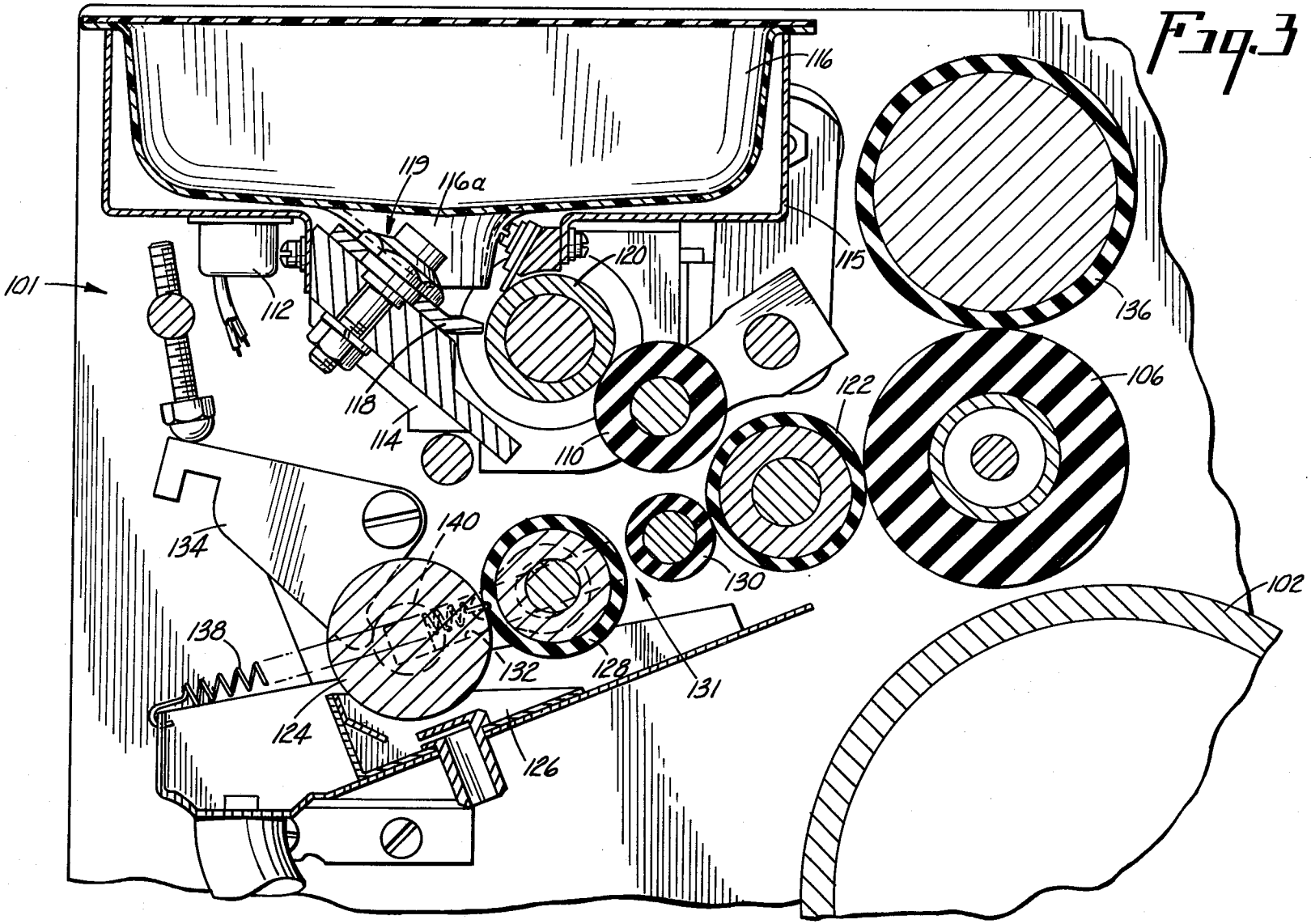
FIG. 3 is a vertical longitudinal section of a portion of the duplicator showing especially the ink and moisture trains.

The ink and moisture system 101, illustrated in detail in FIG. 3, consists of an ink fountain 114 including an ink fountain roller 120 from which ink is carried to an oscillating distributor roller 122 by a ductor roller 110. The ductor roller 110, in the conventional manner, swings rapidly back and fourth between a position of contact with the fountain roller 120 and a position of contact with roller 122. It is customarily driven from the machine drive at a rate proportional to) i.e. in time with) the rotation of the master cylinder 102. This motion is commonly referred to as ducting motion, and the ductor roller and the means for thus operating may be referred to as a ducting mechanism. The distributor roller is in contact with a form roller 106 which deposits the ink on the surface of a master carried by the master cylinder 102.

The form roller 106 also runs in contact with an oscillator roll 136 which rests thereon and provides additional levelling of the ink film on the form roller.

Turning now to the moisture train, a moisture fountain 126 embodies a metallic moisture fountain roller 124 which runs in contact with a moisture distributor roller 128 which is held in contact with a moisture applicator roller 130 during printing. The applicator roller 130 applies a layer of moisture to the surface of the ink on the ink distributor roller 122, from which it is carried to the form roller 106 and deposited thereby on the surface of a master simultaneously with the deposit of ink.

For reasons which will presently appear, means are provided for interrupting the moisture train at appropriate times, and this takes the form of a sliding mounting for the ends of the shafts of fountain roller 124 and moisture distributor roller 128. These shaft ends are slidable in slots in the frame, one of which is shown at 132 in FIG. 3, and the rollers 124 and 128 are jointly shiftable into and out of contact with the moisture applicator roller 130 by a bell crank lever 134 which is operable by any suitable linkage (not shown) which is provided by a solenoid to act against a collar 140 on the shaft of moisture fountain roller 124, thereby shifting the same to the right in FIG. 3, along with roller 128 so that the latter can be brought into contact with the roller 130 at the required times, and a spring 138 is provided for returning the shafts to home or out-of-contact position when the pressure of lever 134 is relaxed. It will be realized, of course, that in the case of lever 134, collar 140 and spring 138, there is a duplicate part on the opposite side of the machine so that both ends of the roller shafts are moved in concert.

The driving arrangement for the rollers is, in the main, conventional and hence has not been shown in detail. It will be understood that the form roller 106 is positively driven at a surface speed equal to that of the master cylinder, and that rollers 122 and 130 are also positively driven at the same surface speed. The ink fountain roller 120 is driven at some suitable predetermined surface speed, in this case about one-fourth the surface speed of roller 122. The ductor roller 110 is driven by frictional contact with either the fountain roller 120 or the roller 122, roller 136 is driven by frictional contact with the form roller 106, and the moisture fountain roller 124 and distributor roller 128 are driven by frictional contact with roller 130 whenever a space 131 therebetween is closed.

It is pointed out that FIG. 3 illustrates the parts in idle position when no printing is taking place. This is indicated by the fact that the form roller 106 is out of contact with the master cylinder, the ink ductor roller 110 is held against the ink fountain roller and spaced from the ink distributor roller 122, and the moisture distributor roller is spaced from the moisture applicator roller 130, as indicated by the reference character 131.

When pre-inking or printing is taking place, the form roller 106 is placed in contact with the master cylinder 102, the ductor roller 110 is moving rapidly back and forth between the ink fountain roller 120 and the ink distributor roller 122, and the space 131 is closed by the levers 134 acting in opposition to springs 138 to complete the moisture train.

While the ink and moisture system has been described as a combined system in which the ink and moisture trains merge to supply a common form roller, it will be understood that, if desired, the principles of the invention can be put to use with equal effectiveness in situations where the ink and moisture trains are independent.

INK FOUNTAIN CONSTRUCTION

Turning now to the ink fountain itself, reference is made to FIGS. 3 to 7, in which the ink fountain roller 120 is seen cooperating with a metering blade 118 which also serves to support a bead of ink 117 which occupies the fountain.

Figure 4:
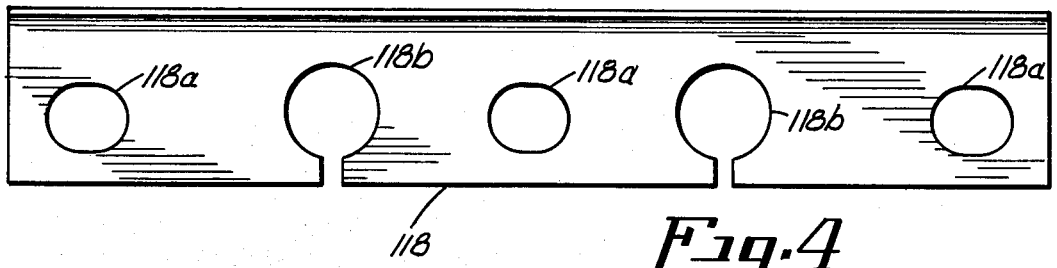
FIG. 4 is a face view of a blade for metering ink on an ink fountain roller.
Figure 5:
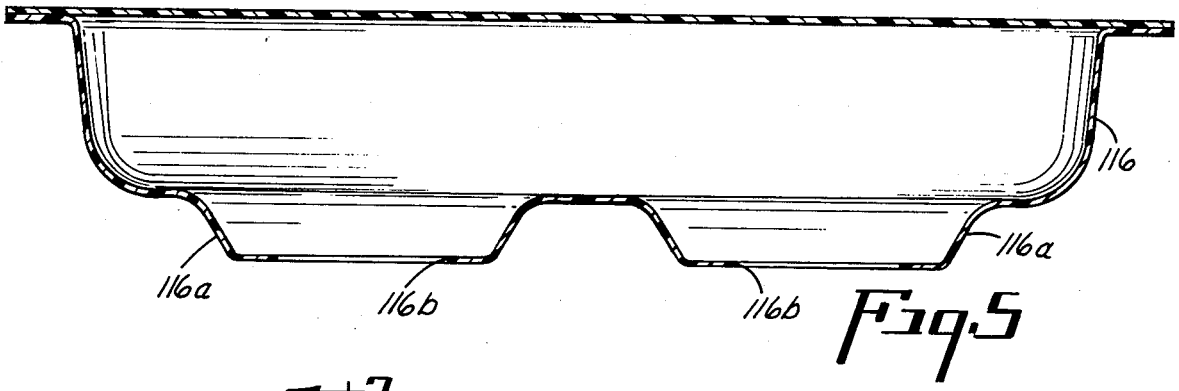
FIG. 5 is a longitudinal section of an ink container.
Figure 6:
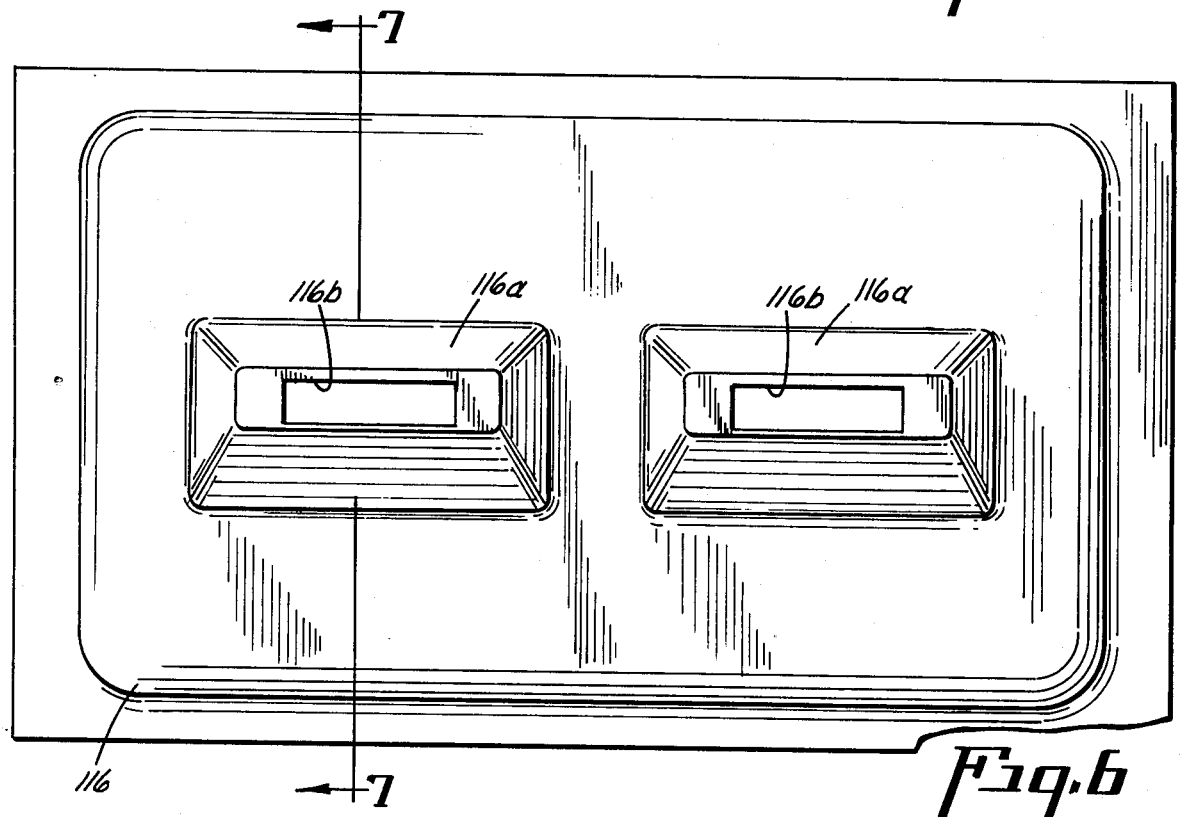
FIG. 6 is a bottom plan view of the ink container of FIG. 5.
Figure 7:
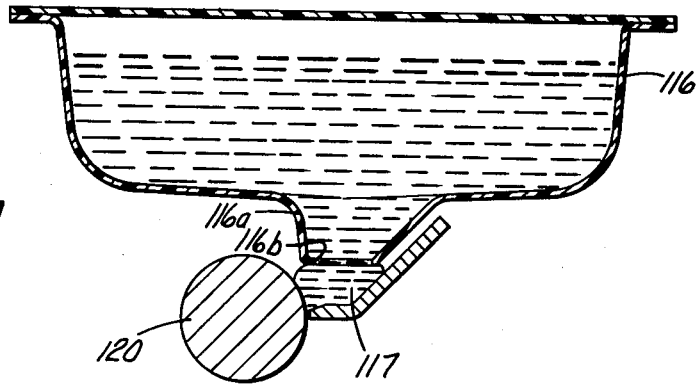
FIG. 7 is a section of the ink container taken on line 7—7 of FIG. 5 but also showing the same in association with the ink metering blade and the ink fountain roller.

The metering blade is so constructed and mounted as to be able to be adjusted radially of the fountain roller to a rather close gap; e.g., about 0.002 inches, being designed as shown in FIG. 4 with mounting openings 118*a* which cooperate with adjusting and clamping devices indicated at 119, and with slots 118*b* which permit the blade to be distorted slightly so as to conform closely to the roll configuration. The details of the blade and its mounting are, however, not related to the present invention and hence are not described in detail.

It is important in the equipment of this invention to provide for extended operation without operator intervention, and an ink supply to be described in detail and claimed in a separate application is provided for this purpose. Briefly this includes a removable and disposable supply container 116 for a substantial supply of ink. The container is sealed at the top and includes elongate nozzles 116*a* with dispensing slots 116*b* which are disposed perhaps one-fourth inch above the surface of the blade 118 when the container 116 is positioned within its support 115.

The ink used in the container 116 is specially designed to be within the higher ranges of flowability for lithographic ink, and hence is able to flow sluggishly from the container onto the blade 118 to form the ink bead 117 (FIGS. 5 and 7) which increases in size until it shuts off flow from the nozzles 116*a*, thereby maintaining a substantially constant volume of ink in the fountain as long as any ink remains in the container 116. When the ink in the container 116 is exhausted, the container can be readily replaced by a casual operator without serious inconvenience.

A temperature sensor 112 (FIG. 3) is mounted on the machine at any point within or close to the ink fountain for directly or indirectly detecting the temperature of the ink. This sensor sends signals which are used in automatically controlling the ink transfer in a manner to be subsequently explained. In the form shown, the sensor 112 is so located that it detects ambient temperature in the close vicinity of the fountain, because the inks described herein have low thixotropic properties and the characteristics of the fountain used do not introduce severe internal temperature changes as the ink is worked, and ambient temperature is close enough to actual ink temperature to work effectively. In other circumstances where a disparity might be encountered, the sensor should be placed in direct contact with the ink in the fountain. Either of these situations may be generally described by the expression "sensing the temperature at the ink fountain".

As stated above, the inks preferably used in connection with this invention have relatively low viscosity and exhibit relatively low values of thixotropy as compared with commonly used lithographic inks. By this is meant inks whose viscosity at 70° F is not above 35,000 centipoises when tested at 21.6 rpm. using a Haake cone and plate viscosimeter, and which exhibit low thixotropic properties such that a viscosity reading taken at 70° F and 21.6 rpm. divided by a viscosity reading taken at 70° F and 583 rpm. will give a ratio not exceeding 3:1. For the purposes of this specification and the subjoined claims, the terms "low viscosity" and "low thixotropy" shall have the significance specified hereinabove.

While the invention is discussed primarily in relation to the use of inks having the special properties defined immediately above, it will be understood that in many respects the principles can be applied with inks of more conventional character. If, for example, customary lithographic inks were to be employed, the disposable container arrangement above-described would be inapplicable and more usual means of supplying the fountain with ink could be resorted to without significantly changing the ink temperature control arrangement. The circuit would merely be readjusted to accommodate the temperature ranges suited to more viscous ink. Presumably a short startup time period would also be incorporated into the system to provide for reducing the ink to workable condition before starting the pre-ink phase. In addition, immersion of the temperature sensor directly in the ink in the fountain would probably be required.

While the invention in general outline can be put to use with a variety of inks, it is one important feature of the invention to employ in this combination lithographic inks of low viscosity and low thixotropy as above-defined. This makes it posible to provide equipment wherein the ink supply is quickly renewable by an unskilled operator, and wherein the temperature sensor is not required to be located within the ink fountain and thus is protected from involvement in the process of changing inks, fountain cleaning, etc., which may be occasionally required.

GENERAL STATEMENT OF OPERATION

The duplicating portion of the above-described device employs as a master M a flexible sheet bearing an image of such character that the image will accept ink while rejecting water, whereas the unimaged, background portions of the master will accept water but reject ink. Consequently, ink applied to the master will be restricted to the image portions and can be transferred image-wise in direct reading fashion onto a copy sheet if the master is provided with a reverse reading image, or it can be transferred to a blanket cylinder from where it is further transferred onto a copy sheet if the master is provided with a direct reading image.

For purposes of this disclosure the apparatus will be described as it would be arranged for reproducing copies from masters bearing reverse reading images. However, it is to be understood that the invention is not so limited and it may be utilized with other duplicating systems including offset duplicating apparatus.

In the idle state of the machine 100, the master cylinder 102 and the impression cylinder 104 are separated to be out of contact with one another and, at this time, the form roller 106 is out of contact with the master cylinder 102. The form roller 106 is effective, when in an operative position, to apply ink and moisture to the master that is attached on the master cylinder 102.

In a pre-inking phase of operation the parts are in the position shown in FIG. 3, except that the space 131 is closed and the moisture train accordingly is conducting moisture, and the ductor roller 110 has started ducting to convey ink. The master has been inserted on the master cylinder 102, and the form roller 106 has been lowered into contact with the master to apply ink and moisture thereto for a predetermined duration thereby conditioning the master for ultimate effective transfer of an ink image to each of the copy sheets to be printed. At this time, however, the impression cylinder 104 is still separated from the master cylinder 102 to restrict the application of ink and moisture to the master alone, and no copy sheet is fed to the impression cylinder 104.

Following the pre-inking phase of operation, and as an incident to a timer determination that the required duration of the pre-inking phase has been satisfied, the first copy sheet C to be printed on is advanced to and clamped on the impression cylinder 104 and concurrently in the machine cycle the impression cylinder 104 is elevated to bring the sheet to be printed into contact with the master on the master cylinder 102. An image is transferred from the master to the copy sheet, the printed copy is ejected from the impression cylinder 104 and a new copy sheet is advanced to the impression cylinder 104 during the print phase. The form roller 106 continues to apply ink and moisture to the master, the latter being maintained in contact with the master cylinder 102 until the required number of copies have been printed.

In the operation of the moisture early arrangement, responding to the condition wherein there has been a predetermined delay (for example of five minutes or more) between the processing of two consecutive masters, moisture is applied to the form roller 106 with the form roller out of contact engagement with the master cylinder 102. There is no master attached on the master cylinder and the space 131 in the moisture train has also been closed. Thus, the moisture train conditions the form roller 106 for a predetermined period of time (approximately three seconds for example) prior to the machine's entering a pre-inking phase.

As is customary in machines of this type, the machine includes a sensing device effective to detect the passage of a copy sheet to the impression cylinder 104. Actuation of this sensing device is a signal for a sequence of events which will result in cylinder engagement. If there is failure to feed a demanded copy sheet, the cylinders 102 and 104 will be separated. The copy sheets thus detected are counted and, upon satisfaction of the required number of copies, the master is ejected from the master cylinder 102, the form roller 106 is elevated to its inoperative position and the cylinders 102 and 104 are again separated.

Figure 2:
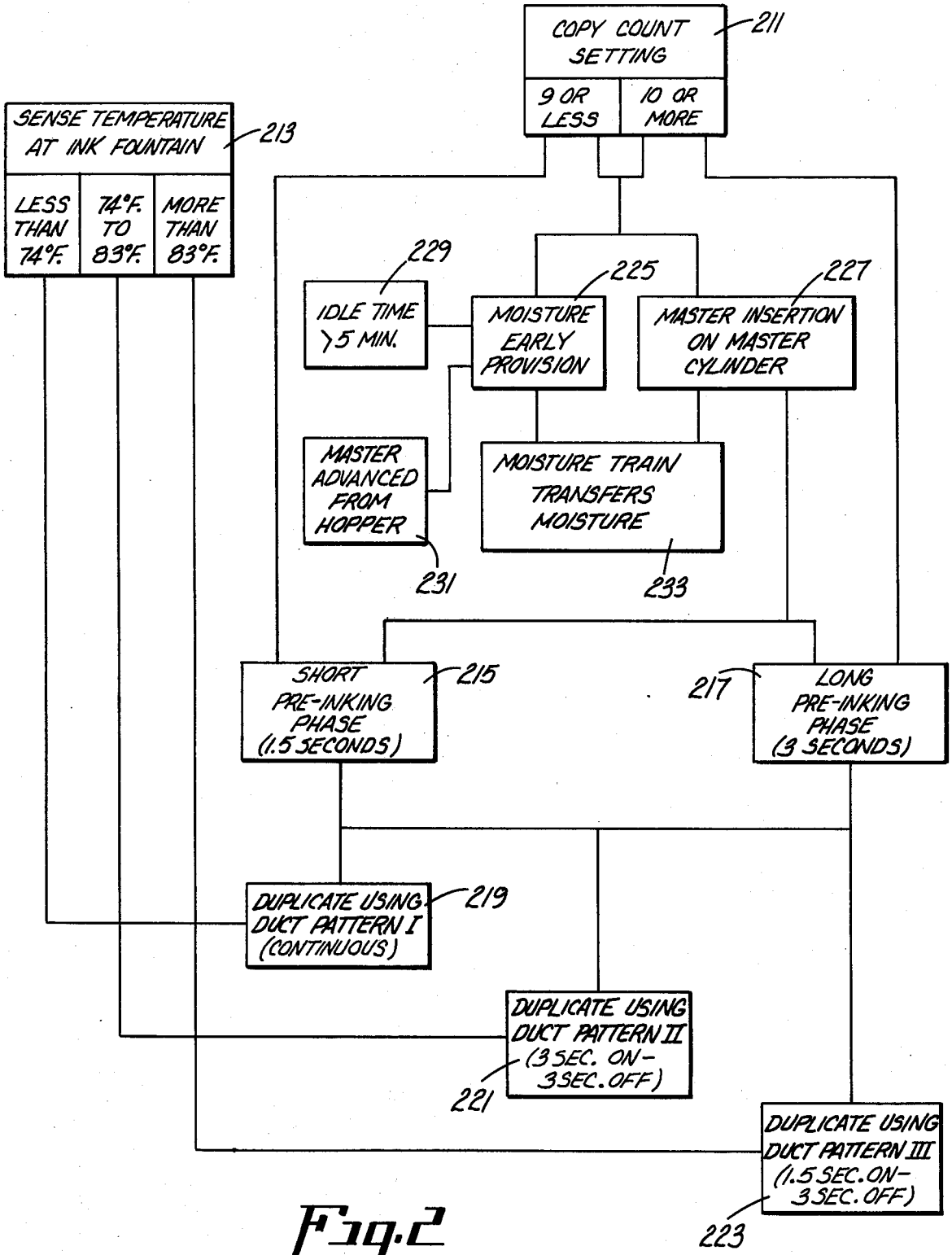
FIG. 2 is a block diagram illustrating the sequence of operation of the duplicator apparatus in accordance with the present invention.

An overview of the central features of the present invention can be had by reference to the block diagram of FIG. 2.

As shown therein, the durations of pre-inking phases, identified as 215 and 217, are under control of a copy count setting 211 of a selectively settable preset counter, and the selection of duct patterns 219, 221 and 223 of the ink ductor roller results from a temperature sensing function 213 (performed by the sensing device 112) for sensing the temperature at the ink fountain. Thus, each pre-inking phase 215 and 217 controls the amount of time that the ink and moisture are applied to the master on the master cylinder prior to duplicating the first copy sheet, and each ducting pattern 219, 221 and 223 of the ink ductor roller controls interruption of ducting movement of the ink ductor roller and holding the same out of engagement with the distributor roller 122 for a predetermined but settable number of machine cycles or seconds at settable intervals, as determined by the sensed temperature.

A further control function 225 is provided for conditioning the ink and moisture rollers prior to a pre-inking phase, and prior to attachment of the master on the master cylinder, in those instances where there has been a delay, for example, of five minutes or more (indicated by numeral 229) between the processing of two consecutive masters which may result in an improper balance of ink and moisture on the rollers. For purposes of this disclosure, this control function 225 which is further described below, is identified as a "moisture early" provision. In those instances wherein there has been less than a five minute delay between the processing of two consecutive masters, the ink and moisture balance on the rollers is not sufficiently disturbed or affected to require operation of the moisture early provision and, therefore, only the pre-inking phase is employed to apply ink and moisture to the master on the master cylinder. When the delay period exceeds five minutes (229) this causes the moisture early provision 225 to activate the moisture system in response to a master's being advanced (231) from the hopper instead of at the time of master insertion (227) onto the master cylinder of the duplicator to allow for conditioning the rollers during the master processing period.

Still referring to FIG. 2, the counter setting action 211 operates the apparatus under the two conditions of count setting. For example, in the preferred embodiment the two conditions may be for duplicating nine copies or less, or for duplicating ten copies or more. In other words, the appropriate division point between a range of count settings which should indicate a printing run receiving the shorter pre-inking period and a range which should receive the longer pre-inking period, is in this particular example, predetermined as being between the settings 9 and 10. Although the apparatus may be arranged for operating at various selected copy quantities in actual practice it has been found that the nine or less and ten or more copy settings described herein provide a favorable division point for altering the duration of the pre-inking phase for the obtaining of optimum quality of duplicated copies.

In response to entering a count of nine or less in the counter (which will be subsequently described) and assuming that there has not been a delay of five minutes or more between the processing of two consecutive masters, electrical circuitry to be described hereinafter conditions the apparatus to advance an imaged master from a rest position or master ramp and to attach the master onto the master cylinder which action is indicated by the reference character 227. In response thereto the system enters the pre-inking phase 215 wherein the ink ductor and the moisture rollers are operative to supply ink and moisture to the form roller and hence to the master on the cylinder. This pre-inking phase with a counter setting of nine copies or less, indicated by the reference character 215, continues for a first predetermined period (e.g. 1.5 seconds) prior to the feeding and duplicating of the first copy sheet using a normal ink ducting motion. Thereafter, during the duplicating of the remaining copy sheets, the ink ducting action will depend upon the temperature control about to be described.

If a temperature of less than 74° F is sensed, the operation of the temperature sensing function 213 causes duplicating to be conducted as at 219 including continuous operation of the ink ductor roller with no interruptions. This continuous ducting pattern is herein referred to as "duct pattern I".

However, if the sensed temperature is between 74° F and 83° F the temperature sensing function 213 changes the duplicating operation as indicated at 221 to include a ducting motion pattern such that the ink ductor roller is interrupted; i.e., it oscillates normally for three seconds, and then remains disengaged from the distributor roller for three seconds, and this is hereinafter referred to as "duct pattern II". Because the viscosity of the ink decreases slightly at this higher temperature and, therefore, flows and is absorbed by the copy sheets more readily, a reduced volume of ink is required on the form roller in order to properly and adequately ink the master to obtain quality duplicated copies. The duration of interruption of the ducting action of the ductor roller operating under the duct pattern II is selected to provide proper ink coverage in those instances wherein the ambient temperature sensed at the ink fountain is, for example, in the range of 74° F to 83° F.

A further type of duplicating operation 223, involves a "duct pattern III", for controlling the ducting action of the ink ductor roller in those instances wherein the sensed temperature is more than 83° F. Under such conditions the viscosity of the ink is decreased further such that the volume of ink required to properly ink the master should also be reduced from that of the duct pattern II. Thus, this reduced volume of ink feed is provided by the duct pattern III which controls the interruption of the ink ductor roller such that it oscillates normally for one and one-half seconds and then remains disengaged from the distributor roller for three seconds. This shorter duration of the engagement of the ink ductor roller with the distributor roller compensates for the further decreased viscosity of the ink to thereby supply a reduced but proper volume of ink to the image areas of the master.

In response to entering (211) a count of ten or more into the counter, and again assuming that there has been less than a five minute delay between the processing of two consecutive masters, the operation is the same as described hereinabove with reference to setting the counter for nine or less copies except that the duration of the pre-inking phase 217 for ten or more copies is for a second, longer predetermined period (e.g.; a period of three seconds instead of 1.5 seconds).

To assist in understanding the reasons for the different duration in pre-inking as a function of copy count setting, the following theoretical explanation may help to indicate the reasons for the successful operation obtained, although it has not been as yet determined whether the nature of the operation conforms precisely with this theory in all respects.

In the first place, in order to insure against over-inking, which introduces many complications to duplicator operations, the basic ink adjustments of the machine are set slightly low, so that extended use at such settings for periods longer than actually contemplated would eventually deplete the ink on the form roller. The ink rollers are then allowed to serve as a controllable ink reservoir to suit the needs of particular printing runs and can never be the source of an over-inked condition due to the basic ink supply settings.

Now, in those instances wherein there are a substantial number of masters to be run in consecutive order, but one or two copies only are to be duplicated from each of the masters, which is an extreme but realistic contingency, the pre-inking phase 217 having a standard duration of three seconds could result in a gradual build-up of ink on the form roller, and produce an eventual oversupply. While this standard three-second duration of pre-inking may not affect the copies duplicated from the first few masters of the ultra-short run series, if the master series is extended enough, in time the ink build-up would result in the form roller's applying an excessive amount of ink to the later masters of the series, and hence to the copy sheets, thereby producing a blurred or smudged image on the duplicated copies.

On the other hand, if the counter were set for duplicating a more usual number of copies, for example, from 10 to 200 copies from each of a series of masters to be run in consecutive order, the pre-inking phase 215 having a special duration setting of 1.5 seconds would result in an insufficient supply of ink on the form roller. This would create a situation reversed from that above in that, although the shorter duration of pre-inking might not unduly affect the copies duplicated from the first few masters if they happened to be runs of ten to fifteen copies, in time the reduced ink supply due to the short pre-ink duration would cause ink starvation of the form roller resulting in the form roller applying an inadequate amount of ink to the later masters of the series, and thus to the copy sheets, thereby producing a faded or faint image on the duplicated copies.

By providing a three-second duration for the pre-inking phase 217 for duplicating fairly long runs from consecutive masters, as in the above example, the form roller is substantially fully replenished after each master with a standard ink supply and, since extremely long runs are not contemplated with the equipment in question (a maximum of 300 copies is common for this type of equipment) there is no chance for the form roller's reservoir to become seriously depleted between replenishments. The moisture early provision 225 referred to earlier is operative, whatever the counter setting, in all instances wherein there has been a predetermined delay (indicated by reference character 229), of five minutes or more, for example, between the processing of two consecutive masters. Thus, because such a dely may result in drying out of the moisture on the rollers, such that the pre-inking phase alone would not sufficiently moisten the master surface at the start of the run to obtain initial quality copies, the moisture early provision 225 provides for supplying moisture to the form roller in response to the action of the machine in advancing the master M from the hopper 24. In this way the rollers comprising the ink and moisture train are, in effect, reconditioned to restore the proper ink and moisture balance prior to the system's entering a pre-inking phase.

CIRCUIT DESCRIPTION

Figure 8A:
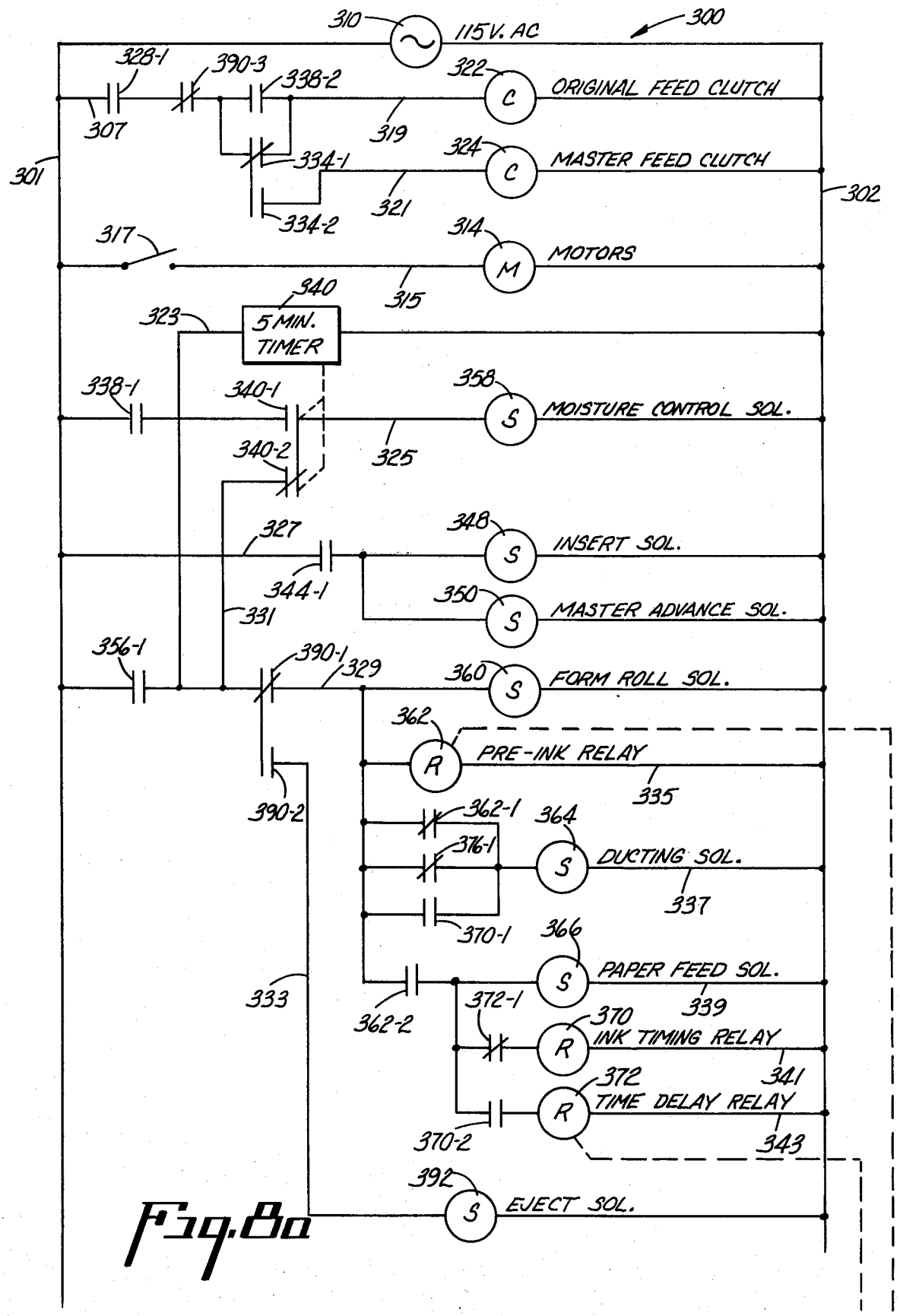

Reference is now had to FIGS. 8A and 8B for a detailed description of the sequence of operation of the machine with reference to the schematic wiring diagram in which is shown an exemplary circuit for causing the duplicating machine to perform in the described manner.

An AC circuit 300 includes a power source 310 and power leads 301 and 302 (FIG. 8A). Power therefrom is also supplied to a DC circuit via a transformer 303 and low voltage power supply 316, which supplies DC power leads 304 and 305 (FIG. 8B).

Reading from the top, the AC circuit includes a conductor 307 which serves a conductor 319 for powering an original feed clutch 322 and a conductor 321 for powering a master feed clutch 324. In series in the conductor 307 are contacts 328-1 of an enabling relay 328 to be subsequently described, and contacts 390-3 of a count-out relay 390 to be later described. The contacts 390-3 are open only when a counter 312 has counted out to zero and the count-out relay 390 is energized, and are closed whenever an unsatisfied count is set in the counter and the relay 390 correspondingly deenergized.

The conductors 319 and 321 are alternately energized from conductor 307 by coupled contacts 334-1 and 334-2 of an original sense relay 334 which will be subsequently described.

A conductor 315 energizes the motors on the duplicator under the control of a switch 317 which may be operator actuated or suitably integrated with the control mechanism for the equipment in various wellknown ways.

A conductor 323 energizes a five-minute timer 340 under the control of contacts 356-1 of a duplicator print relay 356 to be presently described, such that when the contacts 356-1 are closed the timer is held at set position, and when the contacts open, the timer starts to operate, measuring elapsed time. While this has been illustrated as a five-minute timer for the purposes of this disclosure, the timer is preferably adjustable to accommodate various situations, and may be made settable within any desired range, for example, from a period of thirty seconds to a period of five minutes.

A conductor 325 between the power leads provides energization for a moisture control solenoid 358 under the control of contacts 338-1 of a master process relay 338 and contacts 340-1 of the timer 340, the latter being open while the timer is set or running and closed when the timer times out.

A conductor 327 powers an insert solenoid 348 and a master advance solenoid 350 in parallel, both under control of the contacts 344-1 of the insert master relay 344.

A form roll solenoid 360 is energized via a conductor 329 under the control of two sets of contacts in series. Contacts 356-1 of the duplicator print relay 356, previously discussed, provide a primary control and contacts 390-1 of the count-out relay 390 provide a secondary control. The latter are always closed by the relay 390 whenever the counter 312 is in a condition other than zero (i.e.; count-out).

Also under control of the contacts 356-1 is a branching circuit represented by conductor 331 which joins the other contact 340-2 of the timer 340 to provide alternate energization control for the moisture control solenoid 358 at any time when the timer 340 is set or timing.

Normally open contacts 390-2 of the count-out relay 390 also control a conductor 333 (subject also to control by the contacts 356-1) feeding an eject solenoid 392, which triggers removal of a master from the master cylinder.

There are a plurality of branching conductors associated with conductor 329 as follows. Conductor 335 puts a pre-ink relay 362 in direct parallel with the form roll solenoid 360. A ducting solenoid 364 is energized via a conductor 337 in such a way as to have its energization controlled by three sets of contacts in parallel, namely normally closed contacts 362-1 of the pre-ink relay 362, normally open contacts 376-1 of an ink control relay 376, and normally open contacts 370-1 of an ink timing relay 370 to be presently described.

Also branching from conductor 329 is a conductor 339 which energizes a paper feed solenoid 366 under control of contacts 362-2 of the pre-ink relay 362. Also under control of the contacts 362-2 are parallel conductors 341 and 343. The first energizes the ink timing relay 370 under the further control of contacts 372-1 of a time delay relay 372. This time delay relay is fed by the other conductor 343 under the further control of contacts 370-2 of the ink timing relay 370.

Figure 9:
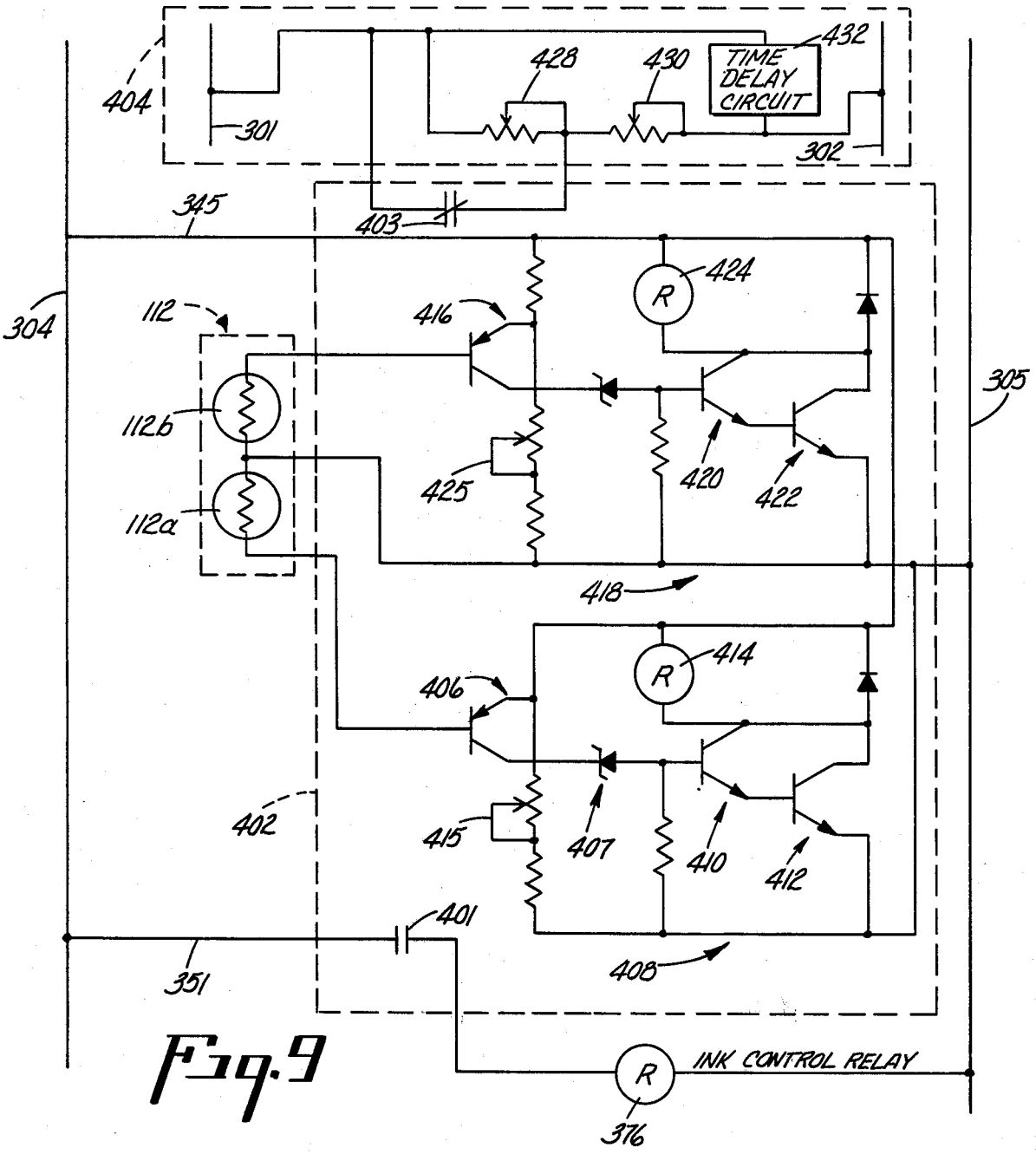
FIG. 9 is a detailed wiring diagram of an exemplary ductor control circuit.

Turning now to the DC circuit of FIG. 8B, a conductor 351 energizes the ink control relay 376, and includes a switch 401 which, for purposes of simplification in this view, is illustrated as a mechanical switch, but which preferably will take the form of relay contacts operated by a coil, both forming part of an electronic dutor control circuit 402 (shown in detail in FIG. 9). This circuit is supplied by a conductor 345 and includes means to receive the electrical input of the temperature sensor 112, previously described, and convert it into switching signals operable at transition points between selected ranges of input values. Below one transition point (74° F, for example) it allows the ink control relay 376 to remain deenergized because switch 401 is allowed to remain open, and above the transition point it closes and energizes relay 376. As will presently appear, this action causes switching of the control function to a control device 404 for selecting the time delay period of time delay relay 372. Immediately above said first transition point it generates a control action which produces a relay 372 delay of one value (e.g., three seconds) and above a second transition point (83° F) it causes a control action which produces a relay 372 delay of another value (e.g., 1.5 seconds).

These temperature values and time delays are, of course, exemplary and are adjustable to suit the requirements of any differences in operating environment, ink properties, etc.

For detecting the presence of an original at the machine input, there is provided a light source 353 which excites a photocell 355 whose output controls an amplifier 357 which, through a switch 359, controls the energization of the enabling relay 328 via conductor 361.

An original sense switch 332, which senses the location of the lead edge of a fed original for timing the feed of a master, in concert therewith, controls the energization of the original sense relay 334 via conductor 363.

A counter of substantially conventional construction is shown at 312, powered by leads 365 from a five-volt power supply 367 which also takes its excitation from the transformer 303. The counter acts to effect switching on the conductor 369 to control the count-out relay 390. For this purpose, again, the switching is shown as a conventional contact switch 371 in the interest of simplifying the electrical diagram, although in the actual construction the counter is preferably electronic and involves semiconductor switch control devices for operating relay contacts. The counter has the additional function of controlling a time delay mechanism 320 of pre-ink relay 362 through another switching device shown as a conventional contact switch 373 controlling a conductor 385 which powers the time control 320. One position of the switch (corresponding to a count setting of nine or less, for example) sets the time delay mechanism 320 for a 1.5 second time period and the other position (corresponding to a count setting of ten or more) sets the time delay mechanism 320 for a three-second period, for example. The time delay mechanism 320 in cooperation with the pre-ink relay 362, hereinabove described, constitute a means for selectively activating the ink and moisture trains for either of two determinate pre-inking periods of different durations.

A conductor 375 provides the input pulses to the counter by means of a paper feed switch 380 which senses the copy sheets as they pass one by one, to the printing station.

A conductor 377 powers the master process relay 338 under control of a master sense switch 336 which is closed by a fed master as it enters the exposure station.

A conductor 379 energizes the insert master relay 344 under the control of a master ramp switch 342 which is closed when it detects the presence of a master at the ramp or waiting station 38 just ahead of the master cylinder.

The duplicator print relay 356 is energized via a conductor 381 under the control of an insert detection switch 352 which is closed when activated by the structural elements of the machine as they complete the cycle of motion related to inserting and clamping the master on the master cylinder. There is also a branching conductor 383 which includes a set of locking contacts 356-2 of the duplicator print relay 356 and which serves to lock in the relay when triggered by the switch 352. A normally closed eject detection switch 394 is in series in the conductor 381. This switch is caused to open and then reclose by the structural elements of the machine related to removal of a master from the master cylinder, and hence will drop out the relay 356 when this occurs.

FIG. 9 shows the details of an exemplary ductor control circuit 402 associated with the sensor 112. As shown the sensor may consist of two thermistors **112*a* and 112*b*. When the temperature is below a predetermined value (in this case 74° F) the circuits are off and no control signal is generated, which allows contacts 376-1 (FIG. A) to remain closed. When 74° F is reached, the thermistor 112*a* reaches a resistance value such that a PNP transistor 406 conducts sufficiently to exceed the breakdown voltage of a zener diode 407. This provides a positive going signal adequate to turn on the darlington network 408, comprising transistors 410 and 412. When these turn on they provide a conductive path adequate to energize a relay 414. This relay includes contacts 401 (corresponding to the switch of the same number in FIG. 8B) which close to energize the ink control relay 376 and thereby open the contacts 376-1. A potentiometer 415 in the emitter circuit is used to set the temperature value at which the PNP transistor 406 will act to turn on the darlington network 408**.

When 74° F is reached, therefore, the only path available to the solenoid 364 is the one which includes contacts 370-1 of the ink timing relay 370 (FIG. 8A), and these contacts are alternately opened and closed by delay type relays 370 and 372 as will be presently explained.

When the next temperature level is reached (say 83° F) the other thermistor **112*b* of the sensor 112 comes into play and, via the base conductor, renders a second PNP transistor 416 sufficiently conducting to turn on, via a zener diode 417, another darlington network 418 (including transistors 420 and 422) and thereby energizes a relay coil 424. The circuit and its operation are basically identical with that described immediately above. The energization of relay coil 424 causes the normally closed contacts 403 (corresponding to the switch 403 shown in FIG. 8B) to open. This has the result of shifting the state of the selective time control 404 for relay 372 by disabling the bypass around one of the potentiometers 428, 430 in a circuit controlling the duration of delay of a time delay circuit 432 associated with the relay 372, and thus altering the delay period to make it shorter. The two potentiometers 428 and 430** serve to provide adjustments for selecting the desired duration for the two different delay periods of which the relay 372 is capable. Along with the relay mechanism, the time delay circuit 432 is powered directly from the high voltage leads 301, 302 as shown.

OPERATION IN DETAIL

With the machine assumed to be turned on and in standby condition with motor switch 317 closed and motor 314 running, the operator places an original at the infeed location 18 and sets the counter 312 for the desired number of copies. In response to entering a count into the counter 312, the count-out relay 390 is deenergized to close contacts 390-3 and prepare the circuitry to operate the original document feed clutch 322.

Placement of an original document to be copied at the machine input is effective to block the light to the original sense photocell 355 and thereby to operate the enabling relay 328 having contacts 328-1 which close, supplying power to the clutch 322 which triggers feeding of the original. Conventional drive means associated with the motors 314 continue to advance the original document to a document sensing switch 332 which is thereby actuated. Actuation of the sensing switch 332 energizes an original sense relay 334 which transfers relay contacts 334-1 and 334-2 and thereby deenergizes the original feed clutch to stop the original in a predetermined registration position, and energizes the master feed clutch 324. The latter triggers feeding of a master and advances the same through the charging station 26 and into proximity to the exposure station 28. There, as the master is entering the process path which includes exposure, development, conversion, and terminates in the attachment of the master onto the master cylinder of the duplicating machine, its lead edge encounters and closes the master sense switch 336 which energizes the master process relay 338. Contacts 338-2 close and restart the motion of the original document in time with the master so that both proceed through the exposure operation in time with each other. At the same time contacts 338-1 close.

At this point either of two conditions may exist. In the circumstance that there has been less than a five minute delay since the processing of the last master, the closing of contacts 338-1 will have no effect, since the applicable conductive path is held open by the timer contacts 340-1 because the timer is still running, thereby preventing transfer of fountain solution to the inking system until such time as the master is attached to the master cylinder. However, if five minutes or more have elapsed since the immediately preceding copies were duplicated, the timer 340 would have timed out and the contacts 340-1 and 338-1 would both be closed. Accordingly the circuit would be operative as a "moisture early provision" and the moisture control solenoid 358 would be energized to close the gap 131 in the moisture roller train, thereby transferring fountain solution to the inking system while the master is being processed and prior to the master's being inserted onto the master cylinder.

As the master advances through the process path it arrives at and comes to rest on the master ramp. In so doing, the lead edge of the master actuates the master ramp switch 342 which provides a path to energize the insert master relay 344 for controlling insertion of the master onto the master cylinder. Responsive to energization of the relay 344, contacts 344-1 close, energizing the master insert solenoid 348 which controls operation of the master cylinder clamp, and the master advance solenoid 350 which causes the master to be fed forward into position for insertion into the clamp. When insertion has been completed, this condition is mechanically sensed and the operation is caused to actuate the corresponding insertion detection switch 352 thereby energizing the duplicator print relay 356 which triggers the printing operation of the duplicator. The relay 356 latches itself in via contacts 356-2 and also, through its contacts 356-1 and the timer contacts 340-2 (normally closed when less than five minutes has elapsed), provides a complete path for power to the moisture control solenoid 358. This causes the moisture train gap 131 to close (if not already closed by the early moisture provision) and thereby to conduct moisture to the master via the ink train.

At this time the counter 312 is in set position (or counting down) and relay 390 is accordingly holding contacts 390-1 closed, so that closing of contacts 356-1 of the duplicator print relay will also (1) energize the form roller solenoid 360 to bring the form roller 106 into contact with the master surface, and (2) energize the pre-ink relay 362 which is in parallel with the form roll solenoid.

The pre-ink relay 362 is a delay-on-operate relay and, as previously described, is capable of either of two delay periods controlled by the delay mechanism 320, selected in response to the copy count set into the counter 312. In response to operation of the relay 362 after expiration of either delay period, the contacts 362-1 are opened and the control of the ducting solenoid 364 is thrown over to either of the other two parallel leads for feeding the conductor 337, which leads are under the control of the ink timing relay 370, the time delay relay 372 and the ductor control circuit 402. This is accomplished upon the closing of pre-ink relay contacts 362-2 as the delay times out, and the printing operation is ready to start.

The closing of contacts 362-2 of the pre-ink relay 362 makes power available to the ink timing relay 370 and the time delay relay 372. Both of these relays are arranged for delay-on-operate action, the latter with two separate selectable time delays (for example; three seconds or 1.5 seconds) under control of the ductor control circuit 402 as controlled by the sensor 112, and the former with settable fixed time delay of, for example, three seconds.

At the time that the pre-ink relay 362 times out and contacts 362-1 open and contacts 362-2 close, this also energizes the paper feed solenoid 366 which initiates the conventional operations necessary to start the feeding of copy paper, and starts the temperature controlled ducting cycle which operates as follows.

If, at this time, the temperature of the ink (in the present situation of the ambient temperature) is below 74° F, the sensor 112 will signal the circuit 402 to that effect, and the switching arrangement indicated at 401 will remain open, leaving the ink control relay 376 deenergized so that its normally closed contacts 376-1 energize the ducting solenoid 364 for continuous operation (ducting pattern I).

If, however, the temperature lies in the range above 74° F, the sensor 112 will signal the circuit 402 to that effect. The switching device 401 will then be closed energizing relay 376 and thereby opening contacts 376-1. In this circumstance, instead of contacts 376-1, energization of the ducting solenoid will be under the control of contacts 370-1 of the ink timing relay 370 which is activated via normally closed contacts 372-1 of time delay relay 372 as soon as relay 362 pulls in and contacts 362-2 close. After the initial time delay (in this instance three seconds), relay 370 is energized and the contacts transfer, that is contacts 370-1 close energizing the ducting solenoid and activating the ducting operation, and contacts 370-2 close energizing the time delay relay 372. The latter delays for a preset period of time set by control 404 (in this instance three seconds) and then its contacts 372-1 open. This triggers a chain reaction in which the relay 370 drops out, thereby opening contacts 370-1 to stop ducting action, and also opening contacts 370-2. This latter condition causes relay 372 to drop out so that contacts 372-1 close, starting a new timing period for relay 370.

It can thus be seen that the relays 370 and 372 alternate in their operation, with the former determining the "off time" of ducting and the latter the "on time".

The foregoing operation continues controlling the ink ductor roller solenoid 364, which controls the ducting pattern of the ink ductor roller (in this case ducting pattern II).

In the case where the temperature sensor 112 indicates a temperature above 83° F, the action is precisely the same as that above-described, except that the circuit 402 selects a shorter delay period for the time delay relay 372 (for example, 1.5 seconds) with the result that the ductor operation periods are shortened and consequently less ink is supplied in a given time. This is the condition referred to as ducting pattern III.

From the immediately foregoing description it is apparent that the sensor 112 senses the temperature at the ink fountain and, responsive to the temperature detected, generates or develops an electrical signal in the form of voltages impressed on transistors 406 and 416 which thereby act to control the speed of transferring ink from the ink fountain roller 124 to the form roller 106. The control of course is exercised by means affecting the average frequency of operation of the ductor roller 110, i.e, the more times the ductor roller operates per unit of time, the faster ink is advanced along the ink train, and conversely, the fewer times it operates per unit of time, the slower ink proceeds along the ink train.

The control just referred to results from the action of the transistors 406 and 416, via darlington networks 408 and 418, on relays 414 and 424 which activate contacts 401 and 403, ink control relay 376 and its contact 376-1, and selective time control 404 which, through relays 370 and 372, controls switch 370-1. As described, the foregoing circuit elements directly control the timing of energization of the ducting solenoid 364 which turns the ductor motion on and off and thereby controls the average number of times that the ductor operates during a determinate time period in terms of machine cylces, and thus the speed of the ink advancement along the ink train.

The apparatus including the transistors 406, 416, the darlington networks 408, 418, the relays 414, 424, contacts 401, 403, relay 376 and its contact 376-1, selective time control 404, relays 370, 372, contacts 370-1 and ducting solenoid 364 thus constitute means acting in response to the sensor produced signals, to automatically control the speed of transfer of ink along the ink train.

As explained above, the effect of an increase in the sensed temperature to certain levels will cause the control to shift the ductor action, by steps, to lower average frequency levels (two steps and three settings being used in the form shown). Conversely, a decrease in the sensed temperature to certain levels will cause the control means to shift the ductor action to higher frequency levels in a similar number of steps or settings. The foregoing relationship, although shown in specific detail as occurring in a two-step, three setting pattern would clearly be equally as effective if arranged to provide many more settings with smaller steps between them, or even a continuous adjusting action. In any case, it will be understood that the procedure described may be generally defined as controlling the speed of transfer of ink from the fountain roller to the ink form roller in inverse relation to the temperature level sensed.

As noted above, in response to energization of the copy sheet feed solenoid 366 by the pre-ink relay 362, sheets are fed into the machine. Each sheet moves past a point where it trips the paper feed switch 380 each time a copy sheet is fed, and this results in stepping the counter 312 once for each sheet until it counts out to zero.

The counting out action of the counter 312 effects completion of a circuit by the switching agency 371 to energize the count-out relay 390, whereupon contacts 390-1, 390-2 and 390-3 of the relay transfer positions from those shown in the drawing. The now open contacts 390-1 remove power from the form roller solenoid 360, the ink ductor solenoid 364, the pre-ink relay 362, the paper feed solenoid 366 and the ink ductor control relays 370 and 372. The now open contacts 390-3 prevent supplying power to the clutches until a new count has been set.

The now closed contacts 390-2 energize the eject solenoid 392 which triggers the mechanism for releasing the master from the master cylinder and feeding it to a disposal point. Completion of the ejection operation is detected through the eject detect switch 394, thereby opening the circuit to the duplicator print relay 356 and dropping it out. This opens the now closed contacts 356-1 of the duplicator print relay 356 and thereby deenergizes the fountain solution control solenoid 358 to open the moisture system gap 131. At the same time, the five minute timer 340 is deenergized to initiate the timing of a new five minute period. At this point the switch 317 may be opened, either manually, or by any suitable automatic control arrangement, to remove power from the motors 314, and the machine operation is returned to a stand-by condition in readiness for a subsequent duplicating operation.

What is claimed is:

1. The method of lithographic duplicating on a rotary lithographic duplicator which comprises applying ink from an ink fountain to a lithographic master on a master cylinder by means of an ink train including a fountain roller and an ink form roller, which includes the steps of:

sensing the temperature at the ink fountain and generating electrical signals indicative thereof; and in response to said signals automatically controlling the speed of transfer of ink from the ink fountain roller to the ink form roller in inverse relation to the temperature level sensed.

2. A method as set forth in claim 1 in which the duplicator ink train includes a ductor roller for transferring ink from the fountain roller to the balance of the train, and in which the step of controlling the speed of ink transfer includes operating the ductor roller at different average frequencies in response to the temperature sensed.

3. A method as set forth in claim 2 in which the ductor roller is normally cycled in step with the duplicator operation, and in which operating the ductor roller at different average frequencies is accomplished by disabling the ductor operation for longer or shorter periods, at predetermined intervals.

4. A method of duplicating as set forth in claim 1 in which the ink employed is a lithographic ink of low viscosity and low thixotropy.

5. A method of duplicating as set forth in claim 1 which further includes applying moisture from moisture fountain to a lithographic master by means of a moisture train, and which includes the step of automatically interrupting the operation of the moisture train to prevent the forwarding of moisture when a used master leaves the master cylinder and the step of automatically restoring operation of the moisture train whenever a new master approaches the master cylinder.

6. A method of duplicating on a rotary lithographic duplicator having a master cylinder which comprises the steps of automatically preparing and processing lithographic masters and forwarding them in sequence to the master cylinder, applying moisture from a moisture fountain to each lithographic master on the master cylinder by means of a moisture train, and which includes the step of automatically interrupting the operation of the moisture train to prevent the forwarding of moisture when a used master leaves the master cylinder, and the step of automatically restoring operation of the moisture train whenever a new master approaches the master cylinder, which method includes the steps of:

automatically measuring the time between the departure of one master from the master cylinder and the preparation of the next master;

when the measured time is less than a predetermined normal dry-out time for the moisture train, automatically triggering the restoration of operation of the moisture train as the new master is inserted onto the master cylinder; and when the measured time exceeds said predetermined normal dry-out time for the moisture train, automatically triggering the restoration of operation of the moisture train during the preparation of the new master approaching the master cylinder substantially in advance of its insertion on the master cylinder.

7. The method of lithographic duplicating on a rotary lithographic duplicator having a master cylinder, an ink fountain and an ink form roller, which comprises:

automatically preparing and processing lithographic masters and forwarding them in sequence to the master cylinder;

applying ink and moisture to the surface of the master on the cylinder by means of ink and moisture trains;

sensing the temperature at the ink fountain and generating electrical signals indicative thereof;

in response to said signals automatically controlling the speed of transfer of ink from the ink fountain to the ink form roller in inverse relation to the temperature level sensed;

automatically interrupting the operation of the moisture train to prevent the forwarding of moisture when a used master leaves the master cylinder;

automatically measuring the time between the departure of one master from the master cylinder and the arrival of the next;

when the measured time is less than a predetermined normal dry-out time for the moisture train, automatically restoring operation of the moisture train as the new master is inserted onto the master cylinder; and when the measured time exceeds said predetermined normal dry-out time for the moisture train, automatically restoring operation of the moisture train during the preparation of the new master approaching the master cylinder substantially in advance of its insertion on the master cylinder.

8. The method of duplicating as set forth in claim 7 which further includes the steps of:

pretreating each new master with ink and moisture for a pre-inking period after its insertion upon the master cylinder and before starting to print;

setting a desired number of copies into a down-counting copy counter; and automatically controlling the duration of the master pre-inking period in dependence upon the setting of the counter.

9. Rotary lithographic duplicating apparatus comprising a master cylinder;

means for inserting a lithographic master on the master cylinder;

means for applying lithographic ink to the master on the master cylinder comprising an ink fountain and an ink train including an ink fountain roller, and an ink form roller;

means for sensing the temperature at the ink fountain and generating electrical signals indicative thereof; and means responsive to said signals for controlling the speed of ink transfer from the ink fountain roller to the ink form roller in inverse relation to the temperature level sensed.

10. A duplicator as set forth in claim 9 in which the last-named means includes a ducting mechanism and means for periodically interrupting the ducting motion in selected time patterns in response to said signals.

11. A duplicator as set forth in claim 9 in which the ink applying means comprises an ink supply for feeding lithographic ink to the ink fountain including:

a container support above the ink fountain; and a readily disposable and replaceable lithographic ink container in the container support, which container has a sealed top and ink dispensing openings at its bottom.

12. A duplicator as set forth in claim 9 which further includes:

settable counter means for determining the number of copies to be printed;

means responsive to insertion of the master onto the master cylinder for initiating a pre-inking cycle before printing; and timing means responsive to said counter setting for controlling the duration of the pre-inking cycle in dependence upon said setting.

13. A rotary lithographic duplicator comprising:

a master cylinder;

means for inserting lithographic masters on said cylinder and ejecting them therefrom;

means for automatically preparing and processing said masters and for forwarding them in sequence to the master cylinder;

a moisture fountain and moisture train for applying moisture to the surface of a master on the cylinder;

means for interrupting the moisture train to prevent the forwarding of moisture concomitantly with a used master being ejected from the cylinder;

means for measuring the time between the departure of the used master from the master cylinder and the preparation of a new master and giving a signal when the measured time exceeds a predetermined normal dry-out time for the moisture train;

means responsive to preparation of the new master in the absence of said signal for restoring operation of the moisture train concomitantly with insertion of said new master on the cylinder; and means responsive to preparation of said new master after said signal is given for restoring operation of said moisture train during the preparation of the new master substantially in advance of its insertion on the master cylinder.

14. A duplicator as set forth in claim 13 wherein there is provided an ink train including an ink fountain, and in which the ink and moisture trains merge to supply ink and moisture to a common form roller.

15. A rotary lithographic duplicator comprising:

a master cylinder;

means for inserting lithographic masters on the master cylinder and ejecting them therefrom;

means for automatically preparing and processing the lithographic masters prior to their insertion on the master cylinder;

means for applying lithographic ink to the master on the master cylinder comprising an ink fountain and an ink train including an ink fountain roller and an ink form roller;

a moisture train for supplying moisture to the surface of the master on the master cylinder;

means for sensing the temperature at the ink fountain and generating electrical signals indicative thereof;

means responsive to said signal for controlling the speed of ink transfer from the ink fountain roller to the ink form roller;

means for interrupting operation of the moisture train to prevent the forwarding of moisture concomitantly with a used master being ejected from the cylinder;

means for measuring the time between the departure of the used master from the master cylinder and the preparation of a new master and giving a signal when the measured time exceeds a predetermined normal dry-out time for the moisture train;

means responsive to preparation of the new master in the absence of said signal for restoring operation of the moisture train concomitantly with insertion of said new master on the cylinder; and means responsive to preparation of said new master after said signal is given for restoring operation of said moisture train during the preparation of the new master substantially in advance of its insertion on the master cylinder.

16. A duplicator as set forth in claim 15 which further includes:

settable counter means for determining the number of copies to be printed;

means responsive to insertion of the master onto the master cylinder for initiating a pre-inking cycle before printing; and timing means responsive to said counter setting for controlling the duration of the pre-inking cycle in dependence upon said setting.

17. A duplicator as set forth in claim 16 in which the ink applying means further comprises an ink supply for feeding lithographic ink to the ink fountain including:

a container support above the ink fountain; and a readily disposable and replaceable lithographic ink container in the container support which container has a sealed top and ink discharging and dispensing openings at its bottom.

18. The method of lithographic duplicating on a rotary lithographic duplicator which includes a down-counting copy counter settable to control the number of copies to be printed in the next printing run of the duplicator, means for selectively activating the ink and moisture trains for either of two determinate pre-inking periods of different durations each of fixed extent, one of said determinate pre-inking periods corresponding to one range of copy count settings of the down-counting copy counter and the other determinate pre-inking period corresponding to another range of copy count settings of the down-counting copy counter, which method comprises applying ink and moisture to the surface of a lithographic master by means of ink and moisture trains and which includes the step of pre-treating each new master with ink and moisture for a pre-inking period before starting to print, and which method further includes the steps of:

setting a desired number of copies into the down-counting copy counter; and automatically controlling the selectively activating means in response to the copy count setting of the down-counting copy counter in a manner to select the determinate pre-inking period corresponding to that range of copy count settings which embraces the existing copy count setting.

* * * * *